US006201558B1

(12) United States Patent
Shirakawa et al.

(10) Patent No.: US 6,201,558 B1
(45) **Date of Patent: *Mar. 13, 2001**

(54) THERMAL HEAD

(75) Inventors: Takashi Shirakawa; Toshifumi Nakatani; Shuuichi Usami; Satoru Sasaki; Tomonari Nanbu; Hirotoshi Terao, all of Iwate-ken (JP)

(73) Assignee: Alps Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/305,105

(22) Filed: May 4, 1999

(30) Foreign Application Priority Data

| | | |
|---|---|---|
| May 8, 1998 | (JP) | 10-125865 |
| May 21, 1998 | (JP) | 10-139839 |
| Mar. 4, 1999 | (JP) | 11-057149 |

(51) Int. Cl.[7] ..... B41J 2/335
(52) U.S. Cl. ..... 347/208
(58) Field of Search ..... 347/200, 208

(56) References Cited

FOREIGN PATENT DOCUMENTS

| | | |
|---|---|---|
| JP 06106758 | 4/1994 | (JP) . |
| 9-123504 | 5/1997 | (JP) . |
| JP 09123504 | 5/1997 | (JP) . |
| JP 10 034991 | 2/1998 | (JP) . |
| JP 10 100460 | 4/1998 | (JP) . |

*Primary Examiner*—Huan Tran
(74) *Attorney, Agent, or Firm*—Brinks Hofer Gilson & Lione

(57) ABSTRACT

A thermal head includes a heat dissipating substrate, a heat-insulating layer formed thereon, a common lead layer formed thereon, an insulating interlayer formed thereon, a plurality of heating elements provided on the insulating interlayer, a common electrode connected to one end of each heating element, and a plurality of discrete electrodes connected to the other ends of the heating elements. The heating elements are connected to each other via the common electrode, and the common electrode is electrically connected to the common lead layer through a contact hole provided in the insulating interlayer. The common lead layer includes a thin region below the heating elements and a thick region.

12 Claims, 12 Drawing Sheets

THERMAL HEAD

BACKGROUND OF THE INVENTION

1. Field of the Invention

The present invention relates to thermal heads mounted in thermal printers or the like. The present invention particularly relates to a thermal head which can suppress voltage drop in a common electrode and can uniformly generate heat along an array of thermal head elements formed in the vicinity of the end of a substrate.

2. Description of the Related Art

In general, a thermal recording head mounted in a thermal printer includes an array of, or a plurality of arrays of, heating elements composed of heating resistors disposed on a substrate. When these heating elements are selectively energized in response to printing information, the heat generated by the elements colors a thermal recording sheet or melts and transfers ink on an ink ribbon onto plain paper or a transparent sheet.

FIG. 15 shows a conventional thermal head. A heat-insulating layer 112 composed of a glass glaze is formed over an entire heat dissipating substrate 111 composed of an electrically insulating ceramic such as alumina. A projecting section 113 which protrudes from the heat-insulating layer 112 is formed by etching or the like in the vicinity of the end 111*a* of the heat dissipating substrate 111. A first common lead layer 114*a* with a thickness of approximately 1 $\mu$m is formed on the entire heat-insulating layer 112 by a sputtering process or the like. The first common lead layer 114*a* is composed of a hard, heat-resistant high-melting point metal, such as chromium, having high adhesiveness to the heat-insulating layer 112. The first common lead layer 114*a* preferably has a large area and a large thickness of approximately 1 $\mu$m to reduce resistance thereof. Furthermore, a second common lead layer 114*b* is deposited on the entire surface of the first common lead layer 114*a* by a sputtering process. The second common lead layer 114*b* is composed of a cermet, which is a composite material of a metal and an insulating ceramic, such as Ta—$SiO_2$ (hereinafter, a Ta-containing cermet is referred to as a"Ta cermet").

A strip antioxidative mask layer adjacent to the projecting section 113 is formed between the end 111*a* of the heat dissipating substrate 111 and the projecting section 113 of the heat-insulating layer 112 and on the second common lead layer 114*b*. The second common lead layer 114*b* is heated to approximately 700° C. so that the second common lead layer 114*b* is thermally oxidized over several thousands angstroms from the surface, except for the portion covered by the antioxidative mask layer. A first insulating interlayer 115*a* composed of oxide ceramic having significantly decreased defects is thereby formed.

The portion protected by the antioxidative mask layer remains as a conductive section 116. The antioxidative mask layer is removed to expose the conductive section 116 on the first insulating interlayer 115*a*.

A second insulating interlayer 115*b* composed of an insulating ceramic such as $SiO_2$ is deposited on the first insulating interlayer 115*a* by a sputtering process or the like, and then a contact hole 115*c* is formed in the second insulating interlayer 115*b* so that the conductive section 116 is exposed from the second insulating interlayer 115*b*.

An underlying common electrode 117*a* composed of a high-melting point metal such as chromium is formed on the second insulating interlayer 115*b* so as to cover the conductive section 116. An array of strip underlying discrete electrodes 118*a* composed of a high-melting point metal such as chromium is formed on the second insulating interlayer 115*b*. These underlying discrete electrodes 118*a* oppose the underlying common electrode 117*a* at a predetermined distance above the projecting section 113.

A plurality of strip heating elements 119 composed of a Ta cermet is provided over the strip underlying discrete electrodes 118*a* and the underlying common electrode 117*a*. Thus, each heating element 119 forms a heating zone S1 between the underlying common electrode 117*a* and the respective underlying discrete electrode 118*a*.

Overlying discrete electrodes 118*b* composed of aluminum or copper are connected to the underlying discrete electrodes 118*a* through the heating elements 119. The overlying discrete electrodes 118*b* extend to the other terminal end of the heat dissipating substrate 111, away from the end 111*a*. Electrical power is supplied to each overlying discrete electrode 118*b* thorough the other terminal end.

An overlying common electrode 117*b* composed of aluminum or copper is formed on the strip heating elements 119 so as to oppose the underlying common electrode 117*a*. Furthermore, a protective layer 120 with a thickness of approximately 5 $\mu$m is deposited over the heating elements 119, the overlying common electrode 117*b*, and the overlying discrete electrodes 118*b* other than the terminal section for an external circuit, by a sputtering process or the like. The protective layer 120 is composed of a material, such as sialon (a solid solution of a Si—Al—O—N compound), having high oxidation resistance and abrasion resistance.

These overlying discrete electrodes 118*b* are energized based on given printing information. A current from a overlying discrete electrodes 118*b* flows in the respective underlying discrete electrode 118*a* and the respective heating element 119, and flows in the underlying common electrode 117*a*, the overlying common electrode 117*b*, the conductive section 116, and the first and second common lead sublayers 114*a* and 115*b* toward the external circuit.

In a typical conventional thermal head including driver ICs, a glazed aluminum substrate is generally used in which a glass material is glazed on a heat dissipating substrate composed of alumina or the like. A plurality of linear heating elements is arranged in the vicinity of the end of the substrate. These heating elements are selectively energized according to recording information. The heat generated in the heating elements records dot images on thermal recording paper or plain paper by ink transfer from a thermal transfer ink ribbon provided between the thermal head and the plain paper.

FIGS. 16 and 17 are a cross-sectional view and a schematic plan view, respectively, of a main section of another conventional thermal head. A glass heat-insulating layer 202 is formed on a heat dissipating substrate 201 composed of an insulating ceramic such as glazed alumina. The heat-insulating layer 202 has a projection 202*a* having a trapezoidal cross-section at the end region. A first common lead layer 203*a*, which is composed of a high-melting point metal and has a thickness of approximately 1 $\mu$m, and a second common lead layer 203*b*, which is composed of a cermet of a high-melting metal and $SiO_2$ and has a thickness of approximately 1 $\mu$m, are formed on the heat-insulating layer 202 including the projection 202*a* by a sputtering process or the like. An antioxidative conductive metal such as $MoSi_2$ or antioxidative insulating ceramic such as $SiO_2$ with a thickness of approximately 0.2 $\mu$m is formed on the second common lead layer 203*b* by a sputtering process. The antioxidative material is etched to form a thermal-oxidation mask layer 204 with a predetermined pattern for providing contact holes by a photolithographic etching process.

The substrate 201 is heated to approximately 600° C. to 800° C. to form a first insulating interlayer 205*a* on the exposed region of the second common lead layer 203*b* which is not covered with the thermal-oxidation mask layer 204, by thermal oxidation. A second insulating interlayer 205*b* composed of $SiO_2$ or the like is formed on the first insulating interlayer 205*a*. Such a double-layered configuration enhances reliability of interlayer insulation. A contact hole 205*c* is formed in the second insulating interlayer 205*b* at the position corresponding to the thermal-oxidation mask layer 204 by a photolithographic etching process. A substrate provided with the layered common electrode is thereby formed. An electrode material composed of a high-melting point metal such as molybdenum is deposited on the second insulating interlayer 205*b* by a sputtering process or the like, and an electrode pattern for an underlying common electrode 206 and underlying discrete electrodes 207 is formed by a photolithographic etching process.

A heating element layer composed of Ta—$SiO_2$ or the like is deposited on the electrode pattern. The heating element layer is etched by a photolithographic etching process to form an array of heating elements 208 corresponding to the number of dots. Any other electrode configuration may also be employed. For example, heating elements 208 with a given pattern are previously formed, and chromium electrodes are deposited on the heating elements 208.

An aluminum or copper overlying electrode layer with a thickness of approximately 2 $\mu$m is formed on the heating elements 208, for supplying electrical energy. Since the multi-layered common electrode is provided at one side of the heating elements 208, no overlying common electrode is necessary at this side. Thus, only three common terminals 209 for external connection for connecting the first and second common lead layers 203*a* and 203*b* to an external circuit are formed on three contact holes 205*c* provided at the two ends and in the center of the substrate 201 (see FIG. 17).

Overlying discrete electrodes 210 for independently heating the heating elements 208 are formed at the other sides of the substrate 1, and first pads 210*a* for connecting driver ICs 211 are formed at the ends of heating elements 208. Second pads 210*b* for connecting the driver ICs 211 and discrete terminals 210*c* for connecting the external circuit are also arranged so as to form an array including the common terminals 209 for connecting the external circuit. These terminals 209*a* and 210*c* and pads 210*a* and 210*b* are plated and connected to the driver ICs 211 and a flexible printed circuit (FPC) 213 as an external circuit by soldering or contact bonding.

A $SiO_2$ or sialon protective layer 212 having high hardness with a thickness of approximately 5 $\mu$m is formed on the heating elements 208 and the overlying discrete electrodes 210 to prevent oxidation and abrasion of these units and electrodes by a sputtering process. The protective layer 212 substantially covers the entire surface other than the terminals 209*a* and 210*c* and the pads 210*a* and 210*b*. After terminal plating, the substrate 201 is cut by a dicing process to form block thermal heads.

In a thermal printer using the conventional thermal head, the overlying discrete electrodes 210 are energized through the respective driver ICs based on the recording signals to selectively heat these heating elements 208 of the thermal head. The heated heating elements 208 transfer ink on a thermal transfer ink ribbon (not shown in the drawing) onto a recording sheet, or colors a thermal recording sheet on a platen (not shown in the drawing), to form a recorded image.

In such a conventional thermal head, the chromium first common lead layer 114*a* must have a large thickness or a large area in order to reduce the resistance and thus to reduce common drop of voltage in the common electrode layer which would leads to deterioration of the quality of the printed image.

When the thickness of the first common lead layer 114*a* composed of a high-melting point metal such as chromium is large, for example, 1 $\mu$m, the layer formed by a sputtering process inevitably has large residual stress in proportion to the thickness due to large tensile stress. Thus, the interfacial bonding strength between the first common lead layer 114*a* and the heat-insulating layer 112 decreases by high-temperature thermal oxidation treatment for forming the first insulating interlayer 115*a* in the subsequent step, by thermal impact during a high-temperature high-vacuum treatment performed for stabilizing the heating elements 119, and by mechanical impact in the subsequent steps. As a result, the quality and the production yield of the thermal head products decrease.

When the common lead layers 114*a* and 114*b* are formed above substantially the entire heat dissipating substrate 111, the probability of insufficient insulation between the common lead layers 114*a* and 114*b* and the overlying discrete electrodes 18*b* due to defects in the insulating interlayers 115*a* and 115*b* increases in proportion to the area of the common lead layers 114*a* and 114*b*, resulting in decrease in the quality and the production yield of the thermal head products.

Since a chromium first common lead layer 114*a* having a large thickness of 1 $\mu$m and high thermal conductivity is present below the heating zone S1, the first common lead layer 114*a* dissipates heat generated in the heating zone S1. Thus, the heating zone S1 cannot be rapidly heated, and the quality of the printed image deteriorates due to decreased thermal printing efficiency.

Since the first common lead layer 114*a* and the second common lead layer 114*b* are formed above the entire heat dissipating substrate 111, the first and second common lead sublayers 114*a* and 114*b* are exposed at the end 111*a* of the heat dissipating substrate 111. As a result, leakage and short-circuiting to external units will occur.

As described above, three contact sections of the common terminals 209 for connecting the external circuit and the common lead layers 203*a* and 203*b* are provided at both ends of the substrate and in the center of the array of the heating elements 208. Thus, the common lead layers 203*a* and 203*b* between the common terminals 209 for connecting the external circuit and the heating elements 208 inevitably have a large length L, and the current path lengths to the heating elements 208 are different from each other.

On the other hand, the common lead layers 203*a* and 203*b* are composed of a high-melting point metal having larger resistivity than that of aluminum or copper. Since the distances between the heating elements 208 and the common terminals 209 for connecting the external circuit are different from each other, the resistances of the common electrode to the heating elements 208 are also different from each other. Thus, the array of the heating elements does not have a uniform temperature distribution which is essential for uniform recording density. When the thickness of the common lead layers is increased in order to solve such a problem, the hard film composed of a high-melting point metal has large tensile strength causing production defects such as interlayer separation, resulting in decrease in quality and yield.

When the common lead layers contain a thick metal layer, heat generated in the heating elements readily dissipates through the metal layer. Thus, the thermal head has low thermal efficiency.

SUMMARY OF THE INVENTION

Accordingly, it is an object of the present invention to provide a thermal head which does not cause insufficient bonding of common lead layers due to film stress and has high thermal efficiency.

A thermal head in accordance with the present invention includes a heat dissipating substrate, a heat-insulating layer formed thereon, a common lead layer formed thereon, an insulating interlayer formed thereon, a plurality of heating elements provided on the insulating interlayer, a common electrode connected to one end of each heating element, the heating elements being connected to each other via the common electrode, and a plurality of discrete electrodes connected to the other ends of the heating elements, the common electrode being electrically connected to the common lead layer through a contact hole provided in the insulating interlayer; wherein the common lead layer comprises a thin region just below the heating elements and a thick region other than the thin region.

Preferably, the thin region of the common lead layer is composed of a high-melting point metal having a melting point of 1,500° C. or more selected from the group consisting of chromium, molybdenum, titanium zirconium, tantalum, niobium, tungsten, and hafnium. On the other hand, the thick region of the common lead layer is preferably composed of a conductive metal having a resistivity of $1\times10^{-7}$ Ωm or less selected from the group consisting of aluminum, copper, gold, and nickel.

In the thermal head having the above configuration, the region just below the heating elements has high heat resistance and prevents undesirable heat dissipation, resulting in improved thermal efficiency. Furthermore, the common lead layer having low resistance can reduce a decrease in voltage in this layer and contributes to uniform heating in the heating elements.

In another aspect of the present invention, a thermal head includes a heat dissipating substrate, a heat-insulating layer formed thereon, a common lead layer formed thereon, an insulating interlayer formed thereon, a plurality of heating elements provided on the insulating interlayer, a common electrode connected to one end of each heating element, the heating elements being connected to each other via the common electrode, and a plurality of discrete electrodes connected to the other ends of the heating elements, the common electrode being electrically connected to the common lead layer by a contact hole provided in the insulating interlayer and to a common terminal for external connection by another contact hole; wherein a plurality of contact holes for electrically connecting the common lead layer to the common terminal for external connection are provided in the insulating interlayer at the discrete electrode side in the vicinity of the heating elements.

Such a configuration can significantly reduce the current path length in the common lead layer between the common terminal for external connection and the heating elements. Since the common lead layer has low resistance, the heating elements have uniform heating characteristics even when the thickness of the common lead layer is decreased.

Preferably, the common terminal for external connection extends in the vicinity of the end of the heat dissipating substrate. Thus, the common lead layer has more uniform resistance with respect to the heating elements. The heating elements have a uniform heating temperature distribution which is essential for uniform recording density.

Preferably, the common lead layer is formed only in the vicinity of the heating elements. In such a configuration, the region of the insulating interlayer is minimized so that the probability of the defects in the insulating interlayer is decreased. As a result, reliability of the insulating interlayer is improved, and the quality and yield of the products are also improved.

Preferably, the common electrode comprises a plurality of layers, and one of these layers comprises a conductive metal having a resistivity of $1\times10^{-7}$ Ωm or less selected from the group consisting of aluminum, copper, gold, and nickel. Such a configuration can achieve further uniform heating in the array of heating elements, resulting in improved quality and yield of the products.

In another aspect of the present invention, a thermal head includes a heat dissipating substrate, a heat-insulating layer formed thereon, a common lead layer formed thereon, an insulating interlayer formed thereon, a plurality of heating elements provided on the insulating interlayer, a common electrode connected to one end of each heating element, the heating elements being connected to each other via the common electrode, and a plurality of discrete electrodes connected to the other ends of the heating elements, the common electrode being electrically connected to the common lead layer through a contact hole provided in the insulating interlayer; wherein the common lead layer has a four-layer configuration comprising a first common lead sublayer comprising a cermet formed on the heat-insulating layer, a second common lead sublayer comprising a metal, a third common lead sublayer comprising a metal, and a fourth common lead sublayer comprising a cermet formed thereon, either the second common lead sublayer or the third common lead sublayer being provided only in the vicinity of the heating elements at the side of the discrete electrodes.

Preferably, the first common lead sublayer is composed of a Ta cermet, the second common lead sublayer is composed of chromium, the third common lead sublayer is composed of chromium, and the fourth common lead sublayer is composed of a Ta cermet.

Preferably, the first common lead sublayer has a thickness of approximately 0.1 μm, one of the second and third common lead sublayers provided only in the vicinity of the heating elements at the side of the discrete electrodes has a thickness of approximately 1 μm, the other common lead sublayer has a thickness of approximately 0.2 μm, and the fourth common lead sublayer has a thickness of approximately 1 μm.

In such a configuration, the first common lead sublayer functions as an adhesive layer between the second common lead sublayer and the heat-insulating layer. Also, the second or third common lead sublayer functions as an adhesive layer for the fourth common lead sublayer. The common lead layer resists separation due to thermal impact in heat treatment steps and mechanical impact in production steps, resulting in improved quality and yield of the products.

The heating efficiency is further improved by reducing the thickness of the common lead layer at only the region below the heating elements.

In this configuration, the thick second and third common lead sublayers can be formed. Thus, the common lead layer has low electrical resistance which does not cause a decrease in voltage applied to the heating elements. As a result, printing density is uniform.

Since the area of the second or third common lead sublayer can be reduced in this configuration, the probability of short-circuiting between the common lead layer and the discrete electrodes due to defects in the insulating interlayer can be reduced, resulting in improved quality and yield of the products.

In another aspect of the present invention, a thermal head includes a heat dissipating substrate, a heat-insulating layer formed thereon, a common lead layer formed thereon, an insulating interlayer formed thereon, a plurality of heating elements provided on the insulating interlayer, a common electrode connected to one end of each heating element, the heating elements being connected to each other via the common electrode, and a plurality of discrete electrodes connected to the other ends of the heating elements, the common electrode being electrically connected to the common lead layer through a contact hole provided in the insulating interlayer; wherein the insulating interlayer is formed on the upper surface of the heat-insulating layer at the peripheral section of the common lead layer so as to cover the peripheral section.

In such a configuration, the common lead layer is not exposed at the end of the heat dissipating substrate and does not cause short-circuiting due to contact with external units.

DESCRIPTION OF THE PREFERRED EMBODIMENTS

Figure 1:
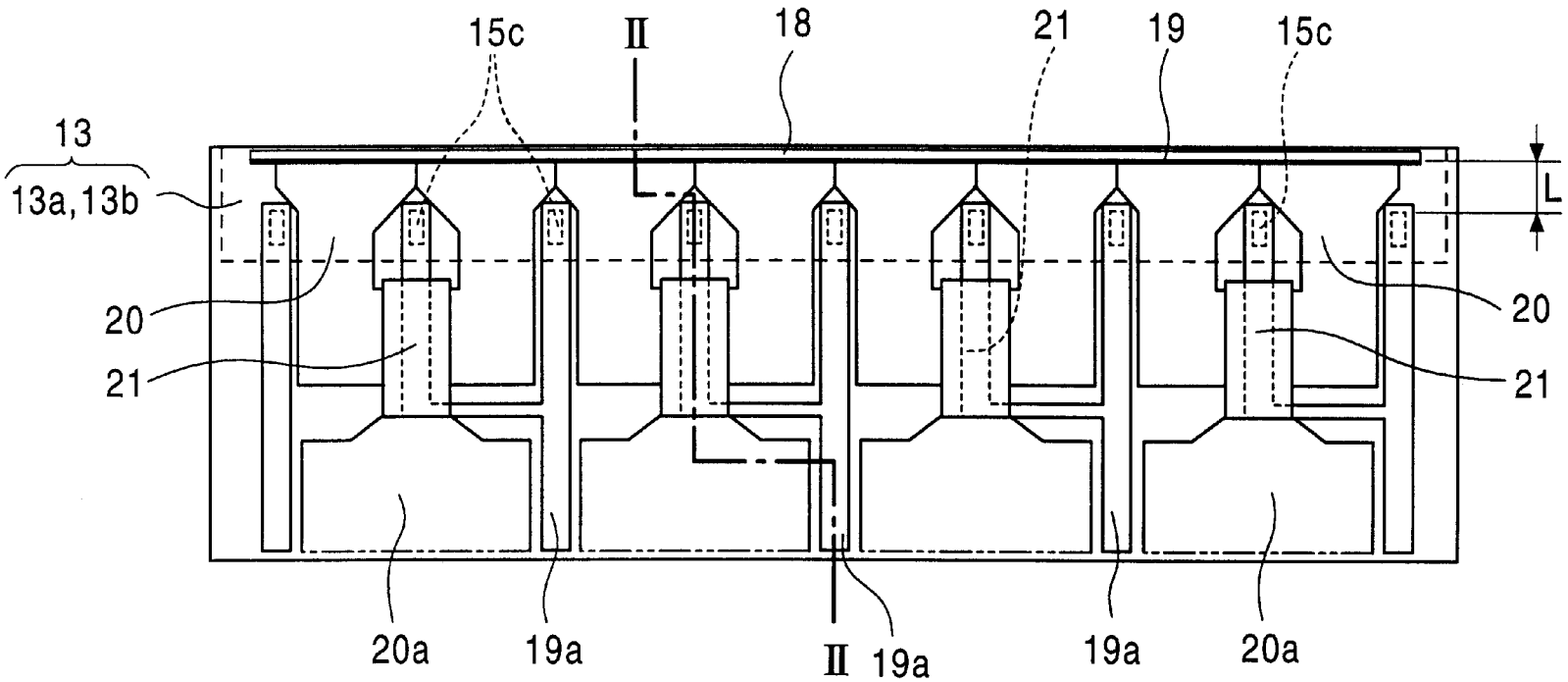
FIG. 1 is a plan view of a first embodiment of a thermal head in accordance with the present invention.
Figure 2:
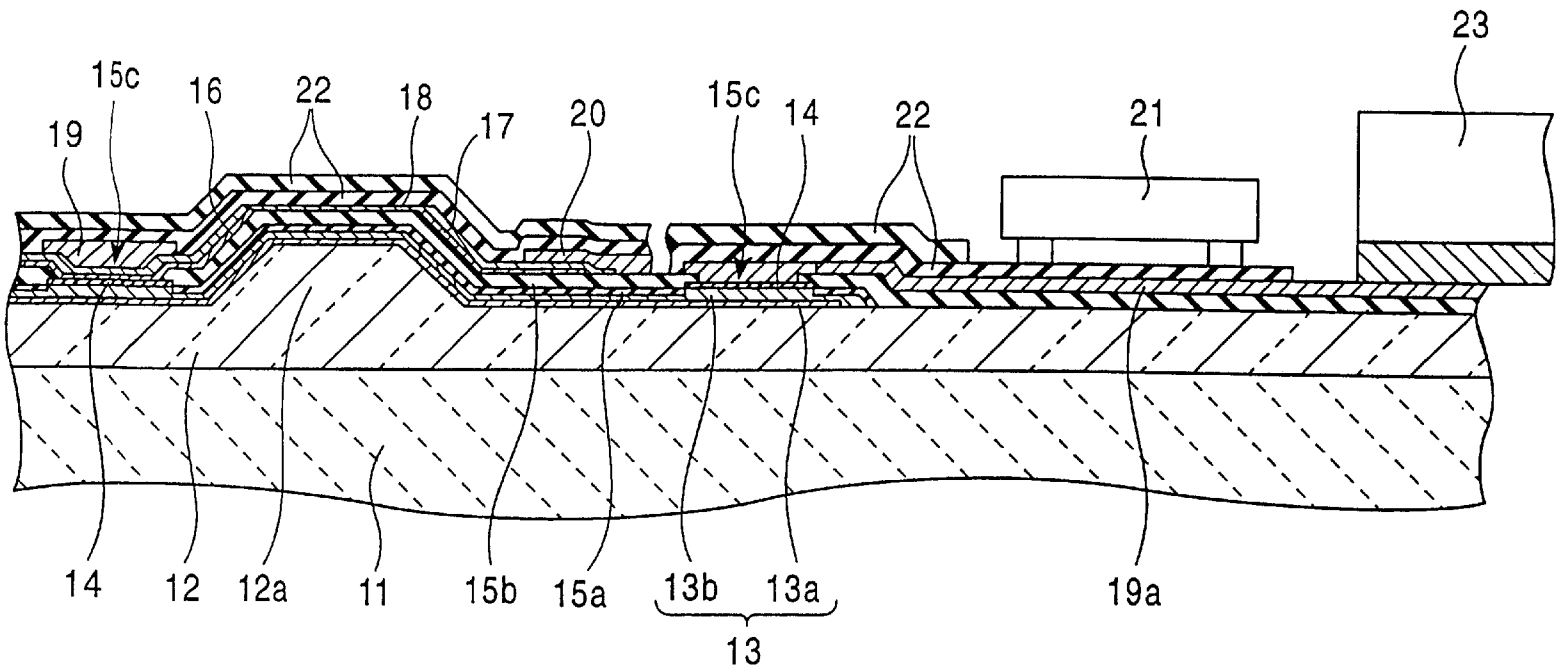
FIG. 2 is a longitudinal cross-sectional view taken along line II—II in FIG. 1.
Figure 16:
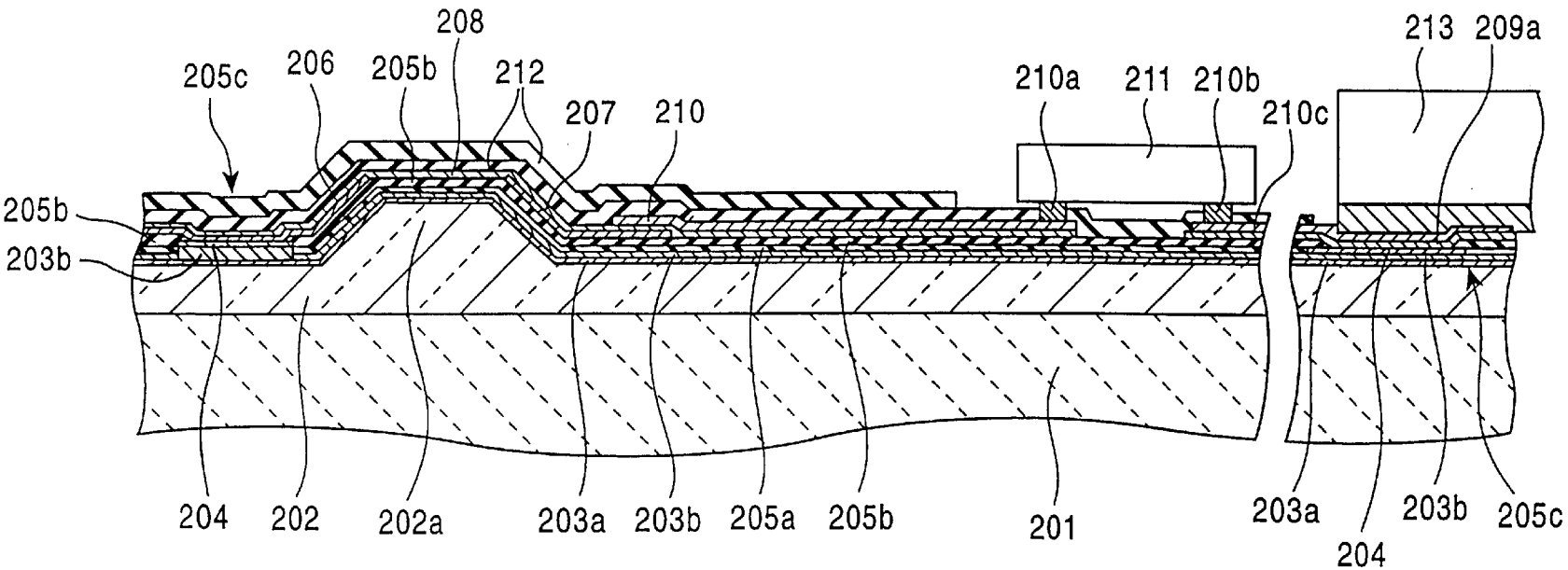
FIG. 16 PRIOR ART
FIG. 16 is a longitudinal cross-sectional view of a conventional thermal head taken along line XVI—XVI in FIG. 17.
Figure 17:
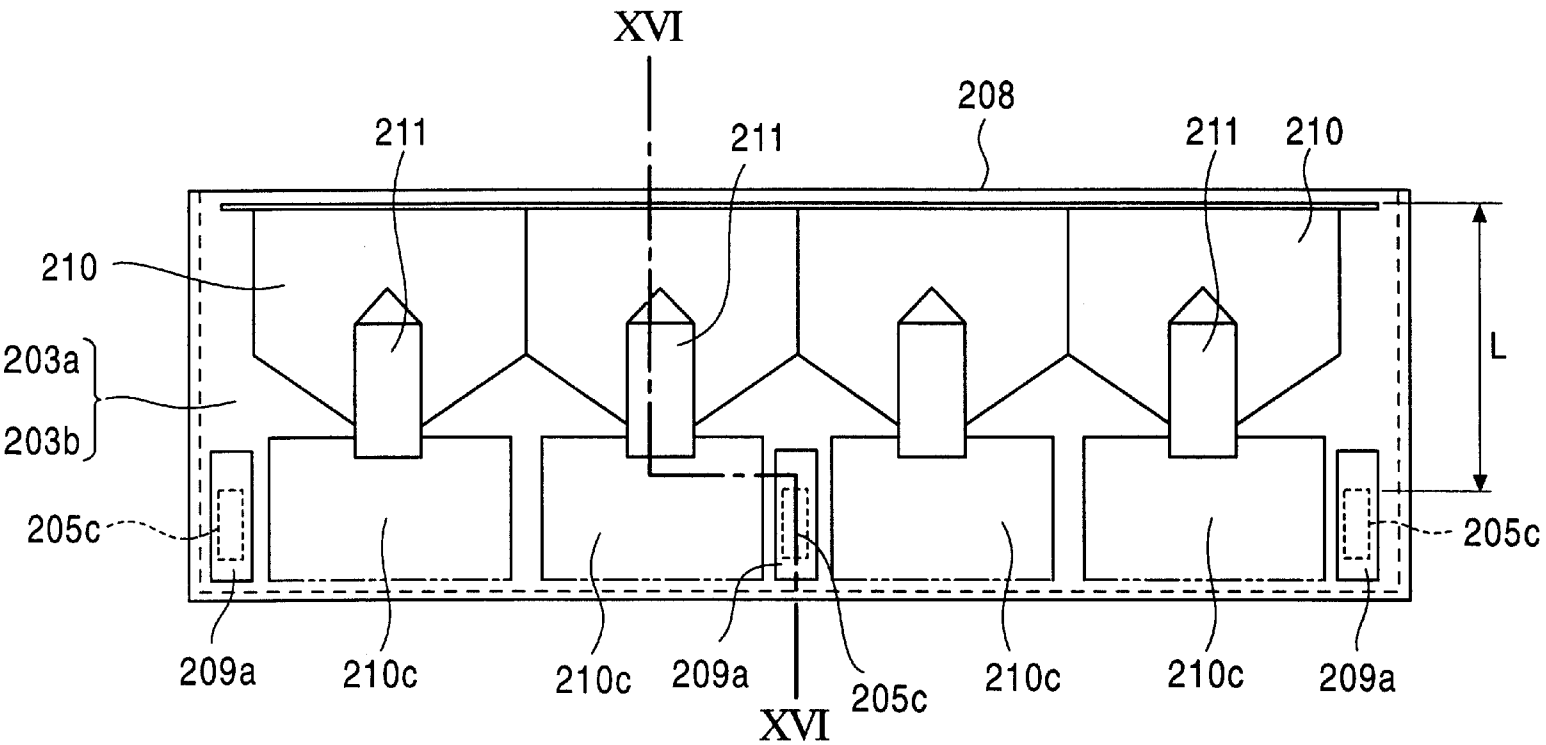
FIG. 17 PRIOR ART
FIG. 17 is a plan view corresponding to the cross-sectional view shown in FIG. 16.

A first embodiment of the present invention will now be described. FIG. 1 is a schematic plan view of a first embodiment of a thermal head having a common lead layer in accordance with the present invention, and FIG. 2 is a longitudinal cross-sectional view taken along line II—II in FIG. 1. In these drawings, a heat-insulating layer 12 having a trapezoidal projection 12*a* is formed on a heat dissipating substrate 11 composed of a ceramic such as glazed alumina in the vicinity of the end by an etching process or the like, as in the conventional thermal heads shown in FIGS. 16 and 17. A first common lead layer 13*a*, which is composed of a high-melting point metal such as chromium and has a thickness of approximately 0.3 $\mu$m, is deposited on the heat-insulating layer 12 including the projection 12*a*, and a second common lead layer 13*b*, which is composed of a high-melting point cermet such as Ta—$SiO_2$ and has a thickness of approximately 1 $\mu$m, is deposited thereon by a sputtering process.

A thermal oxidation mask layer, which is composed of an antioxidative conductive metal such as $MoSi_2$ or insulating ceramic such as $SiO_2$ and has a thickness of approximately 0.2 $\mu$m, is deposited on the second common lead layer 13*b* by a sputtering process, and patterned by a photolithographic etching process to form thermal oxidation masks 14 which are used for forming interlayer contact sections at predetermined positions between the array of heating elements 18 and the array of driver ICs 21.

The heat dissipating substrate 11 provided with the thermal oxidation masks 14 is thermally oxidized at a temperature of 600 to 800° C. in an oxygen atmosphere to form an insulating ceramic oxide layer as a first insulating interlayer 15*a* with a thickness of approximately 1 $\mu$m on the exposed surface of the second common lead layer 13*b*.

A second insulating interlayer 15*b*, which is composed of an insulating ceramic such as $SiO_2$ and has a thickness of approximately 2 $\mu$m is deposited on the first insulating interlayer 15*a*. The second insulating interlayer 15*b* is etched by a photolithographic etching process using buffered hydrogen fluoride (BHF) to form contact holes 15*c* at unoxidized portions provided with the thermal oxidation masks 14 so that the second common lead layer 13*b* composed of Ta—$SiO_2$ is exposed. Such a configuration corresponds to the configuration shown in FIG. 2, but without thermal oxidation masks 14. The configuration shown in FIG. 2 is usable when the thermal oxidation masks 14 are formed of an antioxidative conductive metal such as $MoSi_2$.

An underlying electrode layer, which is composed of a high-melting point metal such as molybdenum and has a thickness of approximately 0.1 $\mu$m, is deposited on the exposed second common lead layer 13*b* by a sputtering process, and is then etched by a photolithographic etching process to form an underlying common electrode 16 and discrete electrodes 17. A heating element layer, which is composed of Ta—$SiO_2$ and has a thickness of approximately 0.3 $\mu$m, is deposited on the underlying common electrode 16 and the discrete electrodes 17, and then etched by a photolithographic etching process to form an array of heating elements 18 formed of the heating element layer above the projection 12*a* of the heat-insulating layer 12 on the heat dissipating substrate 11, corresponding to the number of dots.

An overlying common electrode 19 for supplying electrical power, which is composed of aluminum or copper and has a thickness of approximately 2 μm, is deposited on the heating elements 18 in the vicinity of the end of the substrate 11 by a sputtering process. The overlying common electrode 19 suppresses fluctuation of the heating temperature of the adjoining heating elements 18, although it can be omitted without significant deterioration of functions, since the entire common lead layer 13 including the first and second common lead layers 13*a* and 13*b* functions as a common lead layer.

In this embodiment, aluminum or copper common terminals 19*a* for external connection composed of a low resistance material such as aluminum or copper are disposed between the array of a plurality of the heating elements 18 and the array of the driver ICs 21, electrically connected to the second common lead layer 13*b* through contact holes 15*c* formed in the vicinity of the array of the heating elements 18, and extends towards the vicinity of one end of the heat dissipating substrate 11 through gaps between two adjacent ICs 21 and 21.

The contact holes 15*c* in the second insulating interlayer 15*b* extend parallel to the array of the heating elements 18, and the contact holes 15*c* are disposed at a distance of approximately 2 to 3 mm from the array. Thus, these contact holes 15*c* form an array with a uniform pattern. As a result, the common lead layer 13, including the first and second common lead layers 13*a* and 13*b*, have a small lead distance (L) which minimizes the resistance of the energizing circuit and the pattern area of the common lead layer 13. Accordingly, the probability of defects in the insulating interlayer is decreased and reliability is improved.

At the other side of the heating elements 18, away from the overlying common electrode 19, overlying discrete electrodes 20 and discrete terminals 20*a* for external connection are formed for independently energizing the heating elements 18. Connecting pads for the driver IC 21 are formed at one end of each discrete electrode 20 and at one end of each discrete terminal 20*a*.

These terminals 19*a* and 20*a* for external connection are plated and connected to the driver ICs 21 and an external FPC by soldering or contact bonding. In this embodiment, the driver ICs 21 are mounted by flip chip mounting. Wire bonding mounting may also be employed.

Protective layers 22, which are composed of $SiO_2$ or sialon and have a thickness of approximately 5 μm, are deposited by a sputtering process on the surface of the heating elements 18 and the electrodes 19 and 20 to protect these elements and electrodes from oxidation and abrasion. The protective layers 22 are not formed on the driver ICs 21 and parts of the terminals 19*a* and 20*a* for external connection of the above electrodes 19 and 20. The substrate 11 is cut by a dicing process to form block line thermal heads.

As described above, the common lead layer 13 of the line thermal head in this embodiment have a small lead distance (L) which minimizes the resistance of the energizing circuit and the pattern area of the common lead layer 13. Accordingly, the probability of defects in the insulating interlayer is decreased and reliability is improved. Furthermore, the heating elements have a reduced temperature distribution and can achieve high-quality recording without irregular recording density.

In the thermal head in accordance with the first embodiment of the present invention, as described above, a plurality of contact holes for electrically connecting the common lead layer and the common terminal for external connection are provided in the vicinity of the heating elements rather than the array of the driver ICs at the discrete electrode side. Thus, the current path length of the common lead layer between the common terminal for external connection and the heating elements can be significantly decreased, resulting in decrease in electrical resistance in the common lead layer. Thus, the array of the heating elements has a more uniform temperature distribution in spite of the small thickness of the common lead layer. Accordingly, high-quality recording without irregular recording density is achieved. Furthermore, the common lead layer is free from insufficient bonding due to film stress.

Since a plurality of common terminals for external connection connected to the common lead layer extend to the vicinity of the end of the heat dissipating substrate in the thermal head of this embodiment, the common lead layer has uniform resistance with respect to the array of the heating elements. Thus, the array of the heating elements has a uniform temperature distribution and can achieve more uniform recording density.

Since the common lead layer is formed only in the vicinity of the array of the heating elements in the thermal head in this embodiment, the area for providing the insulating interlayer is significantly reduced. Thus, the insulating interlayer has fewer defects and improved reliability, which contribute to improvement in product quality and yield.

Since one layer of a common electrode including a plurality of layers, which is connected to the heating elements, is formed of a low resistance material such as aluminum or copper, the array of the heating elements has a more uniform temperature distribution. Since the thickness of the first common lead sublayer is further decreased, the quality and yield of the products are significantly further improved.

Figure 3:
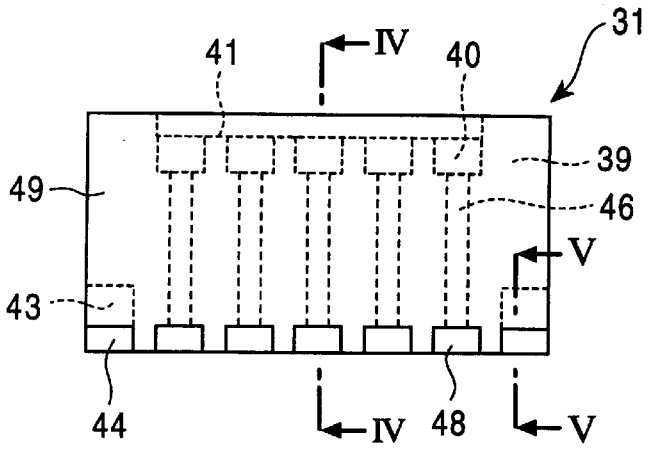
FIG. 3 is a plan view of a second embodiment of a thermal head in accordance with the present invention.

A second embodiment in accordance with the present invention will now be described with reference to FIGS. 3 to 11. FIG. 3 shows a thermal head 31 having five heating elements 40 wherein the number of the heating elements 40 is greatly reduced compared to the number of heating elements in actual thermal heads in order to simplify description thereof.

Figure 4:
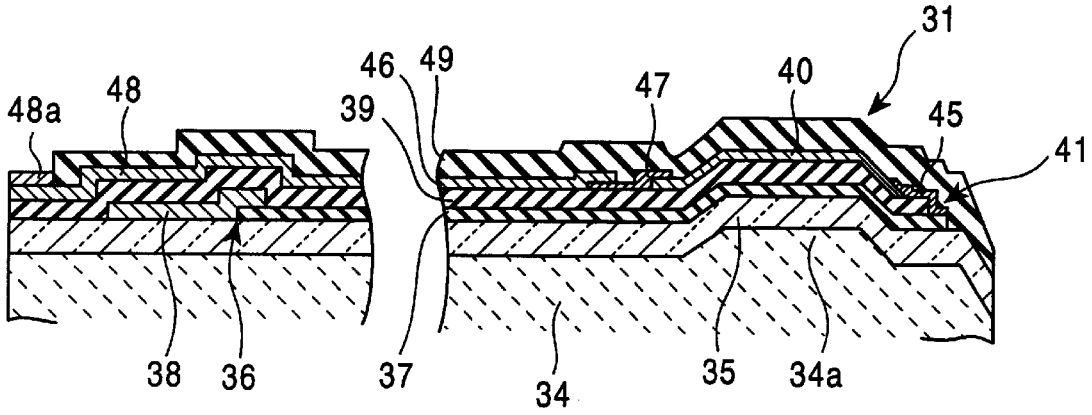
FIG. 4 is a cross-sectional view taken along line IV—IV in FIG. 3.

With reference to FIG. 4, the thermal head 31 in this embodiment has a substantially flat substrate 34. The substrate 34 has a projection 34*a* having a trapezoidal cross-section in the vicinity of the right end. A heat-insulating layer (heat reserving layer) 35 is formed on the substrate 34. The heat-insulating layer 35 is primarily composed of a high-melting point glass which is conventionally used.

A common lead layer 36 as a common electrode is formed over substantially the entire heat-insulating layer 35, and includes a lead layer 37 at the heating element side and a lead layer 38 at the electrode terminal side.

The lead layer 37 extends from the end provided with heating elements 40 (the right end in FIG. 4) to the end of the electrode terminal and has a uniform thickness of preferably approximately 0.15 μm in order to maintain satisfactory thermal response. Since the lead layer 37 is provided under the heating elements 40 heated to high temperatures, it is composed of a high-melting point metal which will not melt at such high temperatures and has a melting point of 1,500° C. or more. Examples of high-melting point metals include chromium, molybdenum, titanium, zirconium, tantalum, niobium, tungsten, and hafnium. The width of the lead layer 37 in the array direction of the heating elements 40 (the transverse direction in FIG. 3) is slightly smaller than the width of the substrate 34.

The lead layer 38 extends from the vicinity of the end provided with the discrete electrode terminals 48 (the left end in FIG. 4) to the upper section of the left end of the lead layer 37. The lead layer 38 is composed of a metal with a low resistivity of $1\times10^{-7}$ Ωm or less. Examples of such metals include aluminum, copper, gold, and nickel. The thickness of the lead layer is considerably large, that is, in a range of 1.0 to 3.0 μm. The width of the lead layer 38 in the vertical direction in FIG. 4 is larger than the width of the lead layer 37.

An insulating interlayer 39 is formed on the lead layers 37 and 38. The insulating interlayer 39 is composed of silicon oxide or silicon nitride to ensure insulation.

The insulating interlayer 39 has a thickness of approximately 1.5 μm.

The end of the insulating interlayer 39 at the heating elements is exposed as a connecting section 41 at the heating element side. A common electrode 45 composed of a high-melting point metal such as molybdenum, chromium, or titanium is formed on the connecting section 41. The overlying heating elements 40 are connected to the common electrode 45. Thus, the lead layer 37 is electrically connected to the overlying heating elements 40 through the connecting section 41. The connecting section 41 and the lead layer 37 are formed substantially in the same region in the direction perpendicular to the drawing shown in FIG. 4.

Figure 5:
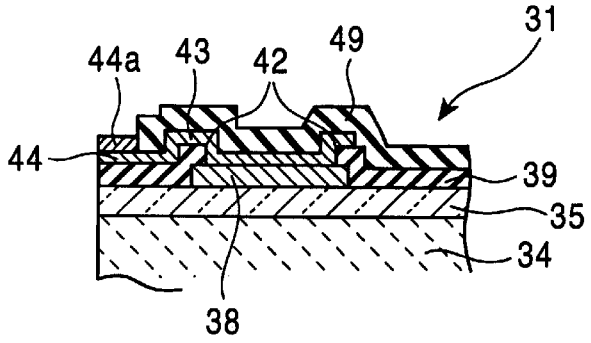
FIG. 5 is a cross-sectional view taken along line V—V in FIG. 3.

With reference to FIG. 5, the lead layer 38 is exposed at two ends in the direction perpendicular to the drawing shown in FIG. 4 and at the side of the electrode terminal to form connecting sections 42. The exposed lead layer 38 is covered with a metal having high electrical conductivity such as aluminum to form a terminal connection electrode 43. The left end of the terminal connection electrode 43 in FIG. 5 functions as a common terminal 44 for external connection, and is covered with a plating layer 44*a*. Thus, the lead layer 38 is electrically connected to the common terminal 44 for external connection through the connecting section 42. The Ta—$SiO_2$ heating elements 40 are formed on the insulating interlayer 39 at the position provided with the projection 34*a*. A predetermined number of heating elements 40, corresponding to the resolution of the thermal head, is arranged in a row in the transverse direction in FIG. 3.

Although the common lead layer 36 is formed substantially over the entire heat-insulating layer 35, other configurations may also be used in the present invention as long as the distances of current passages between the heating elements 40 and the common terminal 44 for external connection are substantially equal to each other.

Discrete electrodes 46 composed of a conductive metal, such as aluminum or copper is formed on the insulating interlayer 39 from the vicinity of the left end of the heating elements 40 to the left end in FIG. 4. Discrete connection electrodes 47 composed of a high-melting point metal, such as molybdenum, chromium, or titanium, is formed under the right end of the discrete electrodes 46 in FIG. 4. The other ends of the discrete connection electrodes 47 are connected to the heating elements 40. Thus, the heating elements 40 are electrically connected to the discrete electrode 46. The left end of each discrete electrode 46 in FIG. 4 functions as a discrete electrode terminal 48 and has a plated discrete terminal section 48*a*.

A protective layer 49 is formed over the heating elements 40, the discrete electrodes 46, the common electrode 45, the discrete connection electrode 47, insulating interlayer 39, the terminal connection electrode 43, the lead layer 37, and the heat-insulating layer 35 to protect these layers from oxidation and abrasion. The protective layer 49 is composed of sialon or a Si—O—N compound having high oxidation and abrasion resistance.

Figure 6:
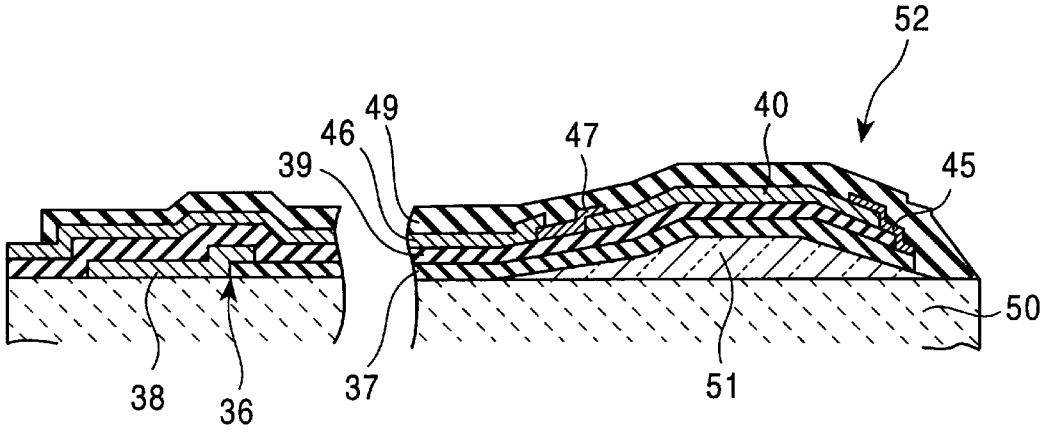
FIG. 6 is a cross-sectional view of a thermal head including a substrate with a glaze layer as a modification of the second embodiment.

The substrate in the present invention is not limited to the S1 substrate provided with the projection 34*a* as shown in FIG. 4. For example, as shown in FIG. 6, a thermal head 52 includes a plane ceramic substrate 50 provided with a projection 51 composed of a glazed layer.

A method for making the thermal head 31 in accordance with the present invention will now be described with reference to FIGS. 7 to 11. As in conventional processes, the method in this embodiment includes simultaneous formation of a plurality of thermal heads 31 on a large substrate 34 and division of the substrate 34 at predetermined positions.

Figure 7:
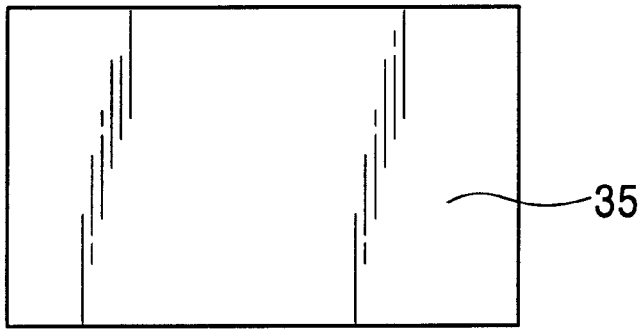
FIG. 7 is a plan view showing a step for forming a heat-insulating layer in a production process for the thermal head shown in FIG. 3.

First, a flat silicon plate is etched to form a substrate 34 having a projection 34*a* by a conventional substrate-forming step. With reference to FIG. 7, a heat-insulating layer 35 with a uniform thickness composed of oxides of silicon and a transition metal is formed on the substrate 34 by a conventional heat-insulating layer forming step.

Figure 8:
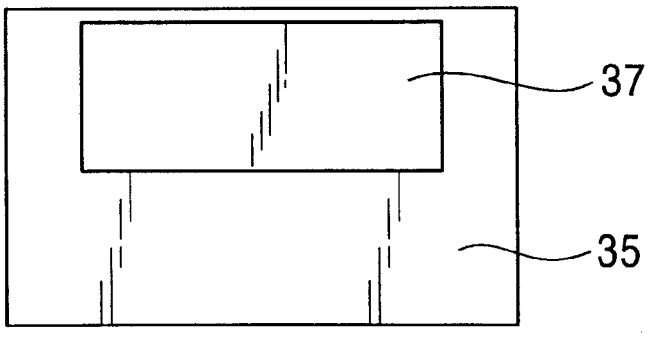
FIG. 8 is a plan view showing a step for forming a lead layer a a heating element side in a production process for the thermal head shown in FIG. 3.

With reference to FIG. 8, a high melting point metal layer with a uniform thickness of approximately 0.15 μm is formed on the heat-insulating layer 35 by a sputtering process (an electrode-layer forming step at the heating element side). The high melting point metal used has a melting point of 1,500° C. or more. Examples of such metals include chromium, molybdenum, titanium, zirconium, tantalum, niobium, tungsten, and hafnium. The metal layer is etched to form a lead layer 37 at the heating element side. It is preferable that the peripheral edge of the lead layer 37 be smaller than that of the substrate 4 in order to prevent undesirable short-circuiting of the lead layer 37.

Figure 9:
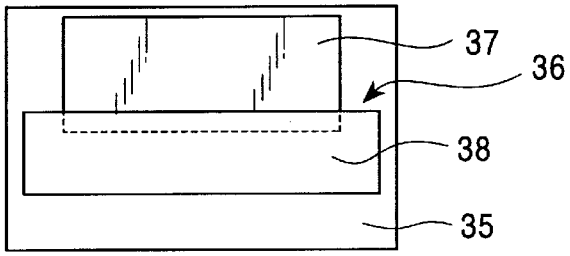
FIG. 9 is a plan view showing a step for forming a lead layer at a electrode terminal side in a production process for the thermal head shown in FIG. 3.

With reference to FIG. 9, a highly conductive metal layer, which has a conductivity of $1\times10^{7}$ Ωm or less and a thickness of approximately 1 to 3 μm and is composed of aluminum, copper, gold, or nickel, is uniformly deposited on the heat-insulating layer 35 and the lead layer 37 at the heating element side by a sputtering process, and is etched to form a lead layer 38 at the electrode terminal side. The lead layer 37 at the heating element side and the lead layer 38 at the electrode terminal side form a common lead layer 36 (an electrode-layer forming step at the electrode terminal side).

An insulating interlayer having a connecting section at the heating element side and connecting sections at the electrode terminal side is formed on the lead layer 37 at the heating element side and the lead layer 38 at the electrode terminal side, in the following insulating-interlayer forming step.

Figure 10:
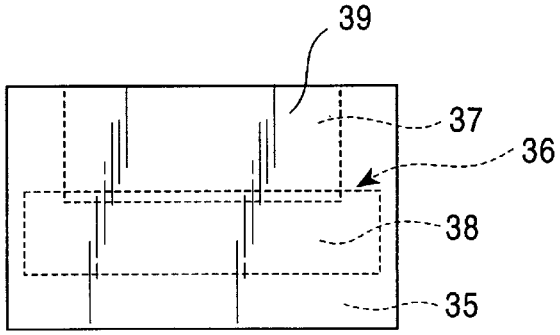
FIG. 10 is a plan view showing a step for forming an insulating interlayer in a production process for the thermal head shown in FIG. 3.
Figure 11:
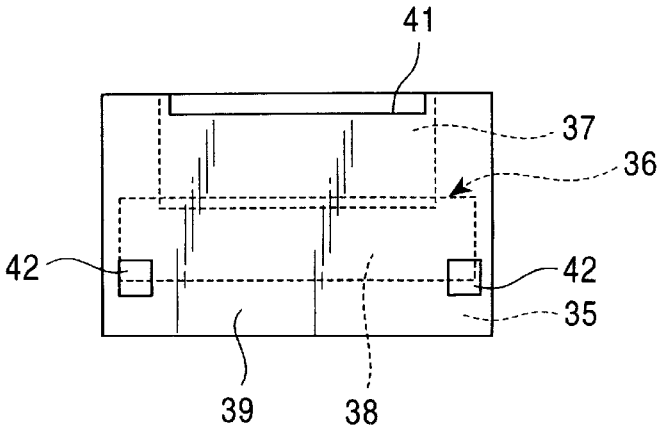
FIG. 11 is a plan view showing a step for forming a connecting section at the heating element side and a connecting section at the electrode terminal side in a production process for the thermal head shown in FIG. 3.

With reference to FIG. 10, an insulating interlayer 39 with a thickness of approximately 1.0 to 3.0 μm is uniformly deposited on the entire surfaces of the lead layers 37 and 38 by a conventional sputtering or CVD process. The insulating interlayer 39 is composed of, for example, $SiO_2$ or a Si—O—N compound. With reference to FIG. 11, a photoresist film is formed over the entire surface of the insulating interlayer 39 by a spin coating process or the like, and is etched using BHF to form a connecting section 41 at a predetermined position of the heating element side and connecting sections 42 at predetermined positions of the electrode terminal side. The lead layers 37 and 38 are exposed at the connecting sections 41 and 42, respectively.

With reference to FIG. 3 again, a heating layer, which is composed of $Ta_2N$ or Ta—$SiO_2$ and has a thickness of approximately 0.3 μm, is uniformly deposited thereon by a conventional sputtering process or the like, and is etched by a photolithographic etching process to form an array of heating elements 40 having a given shape in response to the number of required dots (a heating-element forming step). One side (the right side in FIG. 4) of each heating element 40 is located in the vicinity of the exposed lead layer 37 at the heating element side.

A high-melting point metal, such as molybdenum, chromium, or titanium, is deposited by a sputtering process or the like and etched to form a common electrode 45 having a predetermined pattern over the heating elements 40 and the lead layer 37 at the heating element side (a common electrode forming step). Next, a high-melting point metal, such as molybdenum, chromium, or titanium, is deposited by a sputtering process or the like and is etched to form discrete connection electrodes 47 having a predetermined pattern over the heating elements 40 and discrete electrodes 46 described later (a discrete connection electrode forming step).

A highly conductive metal layer, which is composed of aluminum or the like and has a thickness of approximately 1 to 3 $\mu$m, is deposited by a sputtering process or the like and patterned to form discrete electrodes 46 having a predetermined pattern, which is electrically connected to the heating elements 40 at one side of the discrete connection electrode 47 (the left in FIG. 4) (a discrete electrode forming step).

A highly conductive metal layer, which is composed of aluminum or the like and has a thickness of approximately 0.1 $\mu$m, is uniformly formed by a sputtering process or the like and etched by a conventional process to form a terminal connection electrode 43 having a predetermined pattern which is electrically connected to the lead layer 38 at the electrode terminal side in the connecting section 42 (a terminal connection electrode forming step).

A protective layer 49 with a uniform thickness of approximately 5 to 10 $\mu$m is deposited on the surface other than a common terminal 44 for external connection and discrete electrode terminals 48 by a sputtering or CVD process (a protective layer forming step). The protective layer 49 is composed of sialon or a Si—O—N compound. The common terminal 44 and the discrete electrode terminals 48 are masked using a heat resistant adhesive tape or the like prior to the formation of the protective layer 49, and the mask layer is removed after the formation of the protective layer 49. A plated common electrode terminal 44*a* and plated discrete electrode terminals 48*a* are formed on the exposed common terminal 44 and discrete electrode terminals 48, respectively, by plating. These plated terminals 44*a* and 48*a* are composed of a material having high affinity to solder, such as a Ni—Sn compound. Finally, the large substrate 34 is divided into a plurality of thermal heads 31 by a dicing step.

The operation of this embodiment will now be described with reference to a thermal transfer printer.

The thermal head 31 in accordance with the present invention is mounted onto a carriage of a thermal transfer printer (not shown in the drawing). The thermal head 31 pushes an ink ribbon of a ribbon cassette loaded on the carriage and brings it into contact with a recording sheet. The heating elements 40 are selectively heated based on recording information while the carriage is moved so that the hot heating elements 40 transfer the ink on the ink ribbon to the recording sheet by melting or sublimation.

In further detail, the discrete electrode terminals 48 and the common terminal 44 for external connection of the thermal head 31 in this embodiment are connected to one end of a current-carrying cable (not shown in the drawing). The other end of the cable is connected to a current control section (not shown in the drawing) in the printer body. Signal currents based on the recording information flow to the discrete electrode terminals 48 through the current control section and the cable. The currents pass through the discrete electrode terminals 48 towards the discrete electrodes 46 and the discrete connection electrodes 47. The signal currents reach the heating elements 40 through the discrete connection electrodes 47. The signal currents further flow in the heating elements 40, the common electrode 45, and the lead layer 37 at the heating element side which is present below the heating elements 40. Since the lead layer 37 below the heating elements has a small thickness of approximately 0.15 $\mu$m, the layer does not affect thermal response. Furthermore, heat from the heating elements 40 does not inhibit the current flow in the lead layer 37 formed of a high-melting point metal.

The signal currents pass through the lead layer 37, the lead layer 38 at the electrode terminal side, and the terminal connection electrode 43. Since the lead layer 38 is composed of a highly conductive metal and has a large thickness of 1 to 3 $\mu$m, the resistance of the lead layer 38 in the transvers e direction in FIG. 3 is substantially negligible. Next, the signal currents flow in the common terminal 44 for external connection towards the external circuit of the thermal head 31. The heating elements 40 having high resistance are selectively heated by the signal currents from the discrete electrodes 46 to the common terminal 44.

In this embodiment, the common lead layer 36 including the lead layer 37 at the heating element side and the lead layer 38 at the electrode terminal side are formed below the heating elements 40. Thus, The current path from the common terminal 44 for external connection to the heating elements 40 is shorter than that in a conventional head. Furthermore, the electrical resistance of the highly conductive lead layer 38 at the electrode terminal side is significant low and is negligible in the direction of the array of the thermal head 31 in FIG. 3. As a result, the electrical resistance of the common lead layer 36 is significantly lower than that of a conventional common electrode, and a decrease in voltage (common drop) inevitably occurring in conventional common electrodes can be suppressed. Accordingly, the heating elements 40 can be uniformly energized and heated, and satisfactory images without irregular recording density are obtainable.

This embodiment can be modified as necessary as follows. For example, the common lead layer 36 may be formed of only one metal having a high melting point and high conductivity or of only one metal having a high melting point by a common step.

In accordance with the thermal head of the second embodiment of the present invention, the heating elements can be uniformly heated by suppressing common drop in the common electrode, and satisfactory recording images without irregular recording density are obtained.

Furthermore, the common electrode formed below the heating elements is not melted by the heat from the heating elements.

Figure 12:
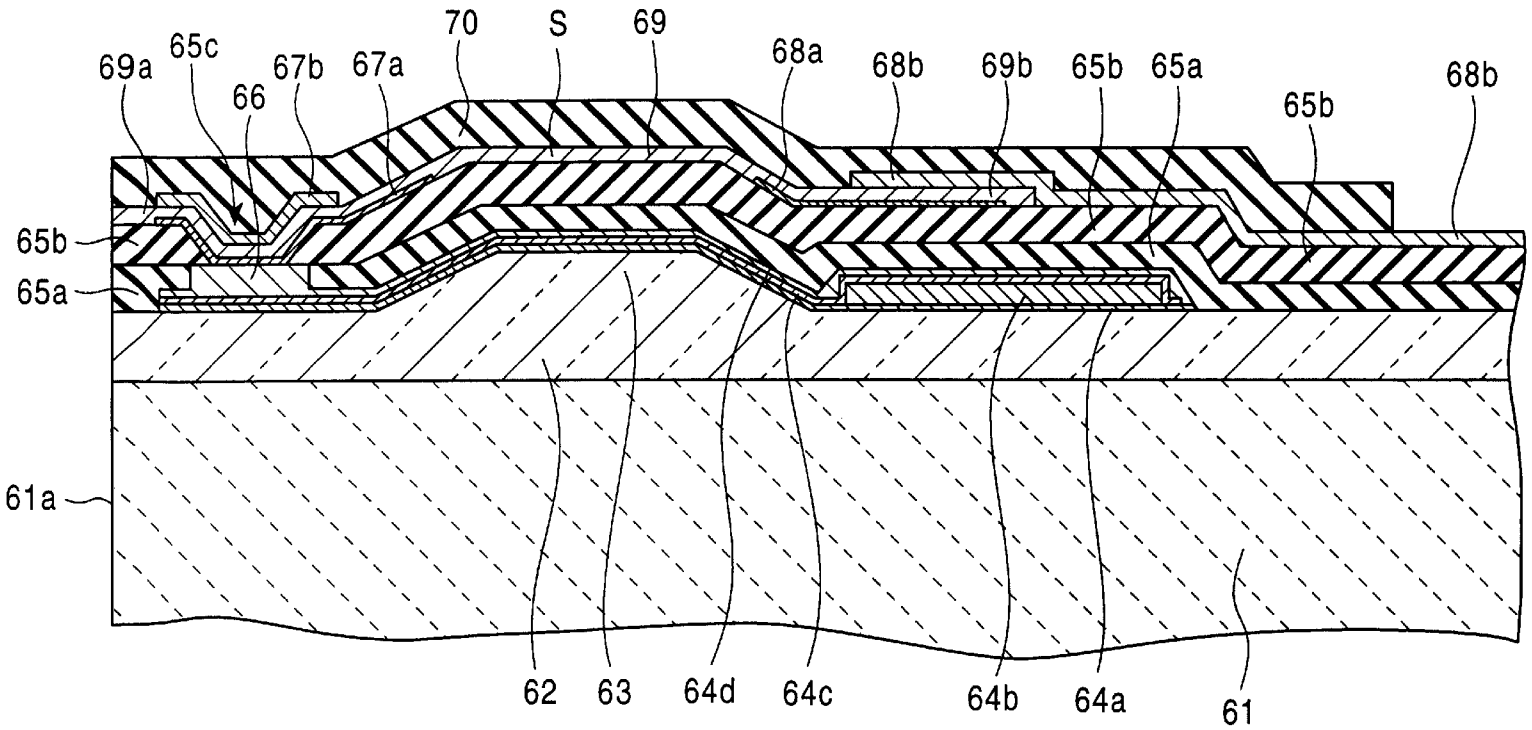
FIG. 12 is a cross-sectional view of a third embodiment of a thermal head in accordance with the present invention.
Figure 13:
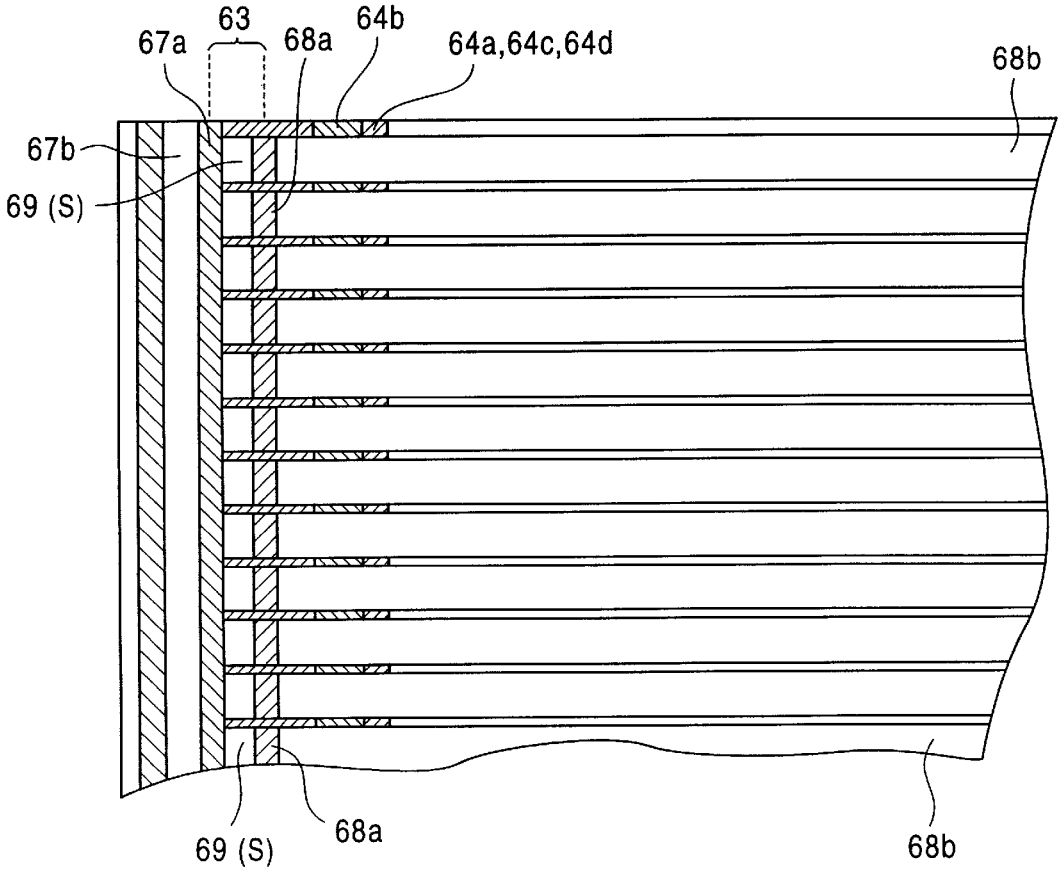
FIG. 13 is a plan view of the main section of the thermal Head shown in FIG. 12.

FIG. 12 is a partial cross-sectional view of a third embodiment of a thermal head in accordance with the present invention, and FIG. 13 is a partial plan view of the thermal head shown in FIG. 12. With reference to FIG. 12, a heat-insulating layer 62 composed of glass glaze is formed on a rectangular heat dissipating substrate 61 composed of an insulating ceramic such as alumina. A projection 63 having a height of approximately 10 $\mu$m from the heat-insulating layer 62 is formed in the vicinity of the end 61*a* of the heat dissipating substrate 61. A Ta cermet first common lead sublayer 64*a* with a thickness of approximately 0.1 μm is formed so as to cover the projection 63 of the heat-insulating layer 62. The first common lead sublayer 64*a* is not formed at the end 61*a* and the other end of the heat dissipating substrate 61. A strip second common lead sublayer 64*b* composed of a high-melting point metal such as chromium is formed on the first common lead sublayer 64*a* so as to adjoin the projection 63 at the side of the other end of the heat dissipating substrate 61 (at the right in the drawing). The second common lead sublayer 64*b* has a large thickness of approximately 1 μm to reduce electrical resistance. A third common lead sublayer 64*c*, which is composed of chromium or the like and has a small thickness of approximately 0.2 μm, is formed so as to cover the first common lead sublayer 64*a* and the second common lead sublayer 64*b*. Furthermore, a fourth common lead sublayer 64*d* composed of a Ta cermet is formed on the third common lead sublayer 64*c*. A protruding strip conductive section 66 is formed on the fourth common lead sublayer 64*d* along the projection 63 at the side of the end 61*a* of the heat dissipating substrate 61 (at the left in the drawing).

The first common lead sublayer 64*a* composed of a Ta cermet functions as an adhesive layer between the heat-insulating layer 62 and the thick chromium second common lead sublayer 64*b*. Furthermore, the thin chromium third common lead sublayer 64*c* decreases the electrical resistance of the second common lead sublayer 64*b* and prevents separation of the second common lead sublayer 64*b* from the first common lead sublayer 64*a*.

A first insulating interlayer 65*a* composed of an insulating ceramic is formed over the substantially entire heat dissipating substrate 61, other than the conductive section 66 of the fourth common lead sublayer 64*d*, to cover the heat-insulating layer 62 at the end 61*a* and the first to fourth common lead sublayers 64*a* to 64*d*. Thus, the surface of the conductive section 66 of the fourth common lead sublayer 64*d* is exposed.

A second insulating interlayer 65*b* which is composed of $SiO_2$ or the like and has a thickness of approximately 2 μm is formed on the first insulating interlayer 65*a* so as to substantially cover the entire surface of the heat dissipating substrate 61. The conductive section 66 of the fourth common lead sublayer 64*d* is, however, exposed to form openings 65*c*.

A strip underlying common electrode 67*a* composed of a high-melting point metal, such as molybdenum, chromium or tungsten, is formed on the conductive section 66 and the second insulating interlayer 65*b* at the left side of the projection 63 of the heat-insulating layer 62. The underlying common electrode 67*a* is electrically connected to the first to fourth common lead sublayers 64*a* to 64*d* at the conductive section 66.

With reference to FIG. 13, a plurality of rectangular underlying discrete electrodes 68*a* composed of a high-melting point metal, such as molybdenum, chromium, or tungsten, is formed on the second insulating interlayer 65*b* at the right side of the projection 63 of the heat-insulating layer 62. Thus, the underlying discrete electrodes 68*a* are opposing the underlying common electrode 67*a* at a predetermined distance so as to sandwich the projection 63.

A plurality of rectangular heating elements 69 composed of a Ta cermet is formed on the second insulating interlayer 65*b*. One end 69*a* of each heating element 69 is connected to the underlying common electrode 67*a*, and the other end 69*b* is connected to the respective underlying discrete electrode 68*a*. A zone S between the underlying common electrode 67*a* and the underlying discrete electrode 68*a* of each heating element 69 is heated.

An overlying common electrode 67*b* composed of a highly conductive material, such as aluminum or copper, is formed on the heating elements 69 so as to face the underlying common electrode 67*a*, and is connected to the end 69*a* of each heating element 69, like the underlying common electrode 67*a*. The underlying common electrode 67*a* extends towards the projection 63 compared to the overlying common electrode 67*b*.

Overlying discrete electrodes 68*b* composed of a highly conductive material, such as aluminum or copper, face the underlying discrete electrodes 68*a* so as to sandwich the heating elements 69, and are connected to the other ends 69*b* of the heating elements 69. The underlying discrete electrodes 68*a* extend towards the projection 63 compared to the overlying discrete electrodes 68*b*. In contrast, the overlying discrete electrodes 68*b* extend to the other end of the heat dissipating substrate 61, as shown in FIG. 13.

A protective layer 70, which is composed of an oxidation and abrasion resistant material such as sialon and has a thickness of approximately 5 μm, is formed by a sputtering process over the heating elements 69, the overlying common electrode 67*b*, and the overlying discrete electrodes 68*b* other than the terminal section for an external circuit.

Figure 14:
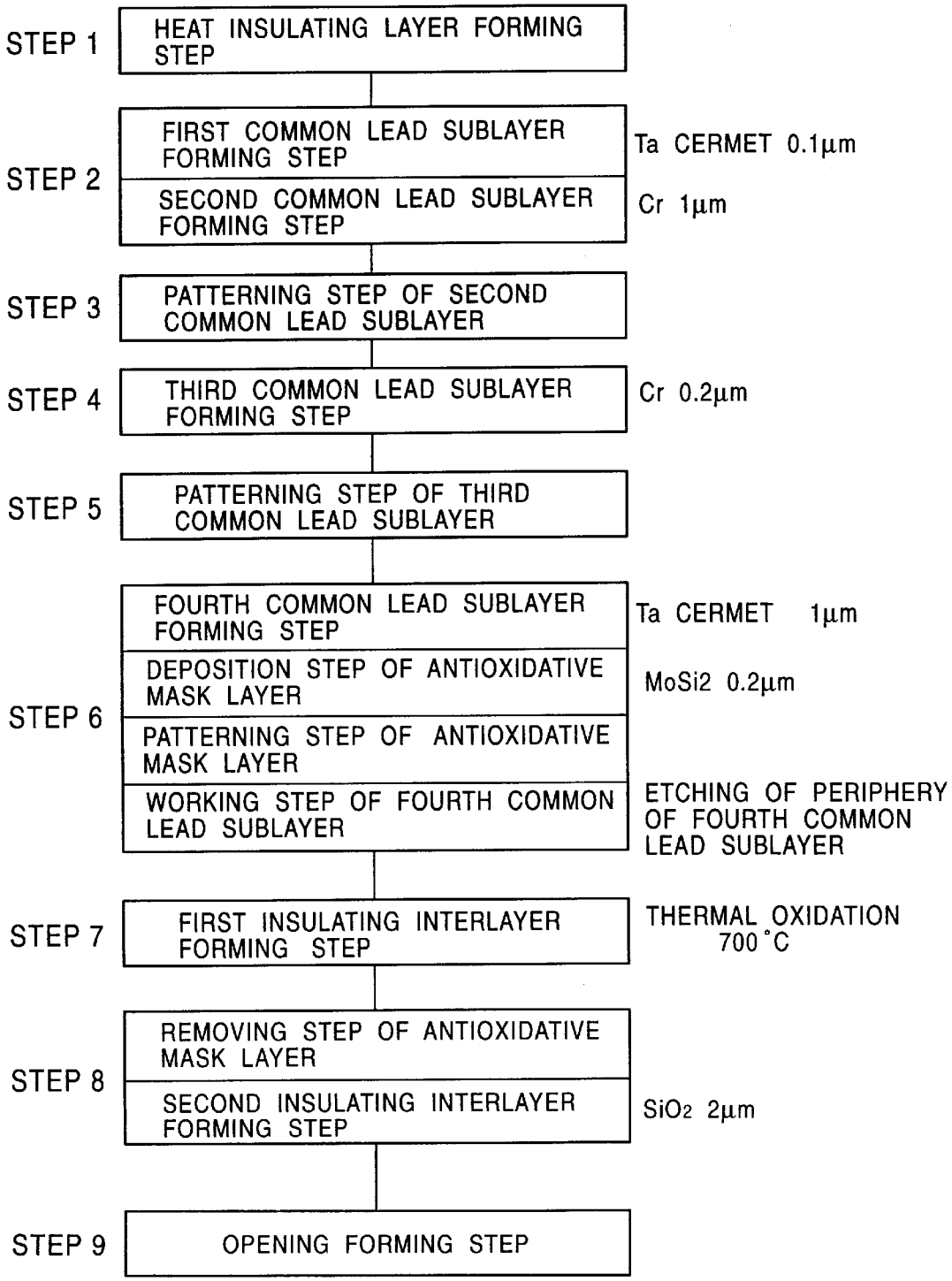
FIG. 14 is a flow chart of production steps for the thermal head shown in FIG. 12.
Figure 15:
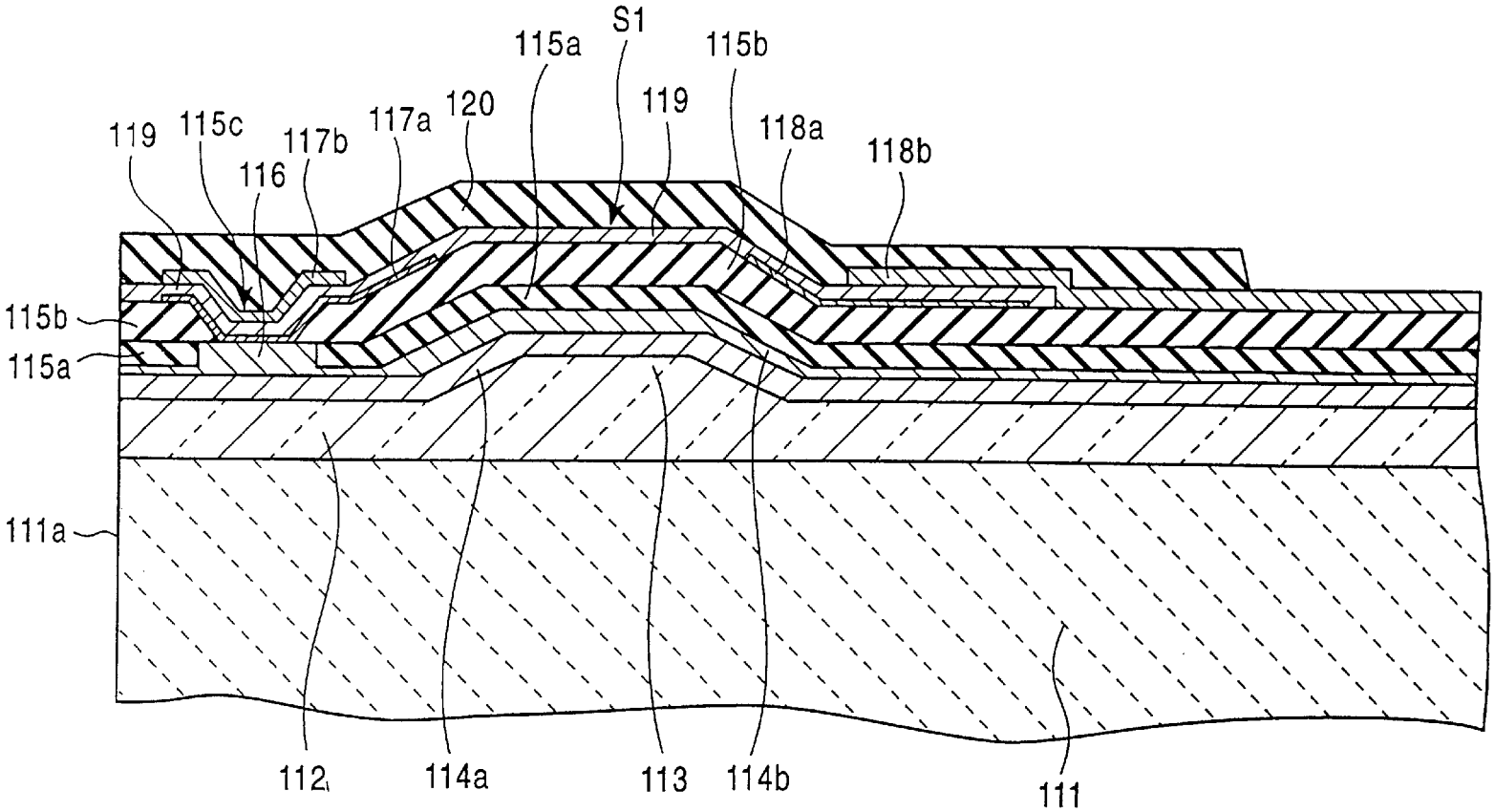
FIG. 15 PRIOR ART
FIG. 15 is a cross-sectional view of the main section of a conventional thermal head.

In a method for making the thermal head in this embodiment, steps for forming the first to fourth common lead sublayers 64*a* to 64*d* and the first and second insulating interlayers 65*a* and 65*b* will now be described with reference to the flow chart in FIG. 14.

A heat-insulating layer 62 composed of glass glaze or the like is formed on a heat dissipating substrate 61 composed of an insulating ceramic such as alumina, and is etched to form a projection 63 at the side of one end 61*a* of the heat dissipating substrate 61 (Step 1: heat-insulating layer forming step).

A first common lead sublayer 64*a* with a thickness of 0.1 μm is substantially formed on the entire heat dissipating substrate 61 provided with the heat-insulating layer 62 by a sputtering process in a first common lead sublayer-forming step. Then, a second common lead sublayer 64*b* with a thickness of approximately 1 μm is formed on the first common lead sublayer 64*a* by a sputtering process in a second common lead sublayer-forming step (Step 2).

The second common lead sublayer 64*b* is patterned by a photolithographic etching process to form a strip adjacent to the heating zone S at the side of discrete electrodes 68*a* and 68*b* (Step 3: patterning step of second common lead sublayer).

A chromium third common lead sublayer 64*c* with a thickness of approximately 0.2 μm is formed on the second common lead sublayer 64*b* (Step 4: third common lead sublayer forming step).

The third common lead sublayer 64*c* is patterned by a photolithographic etching process to form a strip extending to the vicinity of the end 61*a* of the heat dissipating substrate 61 (Step 5: patterning step of third common lead sublayer).

A fourth common lead sublayer 64*d*, which is composed of a Ta cermet or the like and has a thickness of approximately 1 μm is substantially formed above the entire first common lead sublayer 64*a* in a fourth common lead sublayer forming step. An antioxidative mask layer, which is composed of an antioxidative ceramic or alloy, such as $SiO_2$ or $MoSi_2$, and has a thickness of approximately 0.2 μm, is deposited on the fourth common lead sublayer 64*d* in a deposition step for the antioxidative mask layer. The antioxidative mask layer is patterned by a photolithographic etching process in a patterning step of the antioxidative mask layer so that the antioxidative mask layer remains only at the position for forming a conductive section 66 of the fourth common lead sublayer 64*d*. The fourth common lead sublayer 64*d* is partially etched by a photolithographic etching process in a working step of fourth common lead sublayer, until the thickness is approximately half or less at the periphery of the third common lead sublayer 64*c* (Step 6).

The fourth common lead sublayer 64*d* is heated to a temperature of approximately 700° C. for thermal oxidation in a first insulating interlayer forming step. In the thinned section of the fourth common lead sublayer 64*d*, the first and fourth common lead sublayers 64*a* and 64*d* are completely oxidized. In the untreated section of the fourth common lead sublayer 64*d* having the original thickness of approximately 1 μm, the upper half layer of the fourth common lead sublayer 64*d* is oxidized. A first insulating interlayer 65*a*, which is composed of an insulating ceramic formed by oxidation of the Ta cermet and does not have substantial defects, is thereby formed. The first insulating interlayer 65*a* covers the deposited first to fourth common lead sublayers 64*a* to 64*d* and the peripheral section (Step 7).

The antioxidative mask layer is removed by etching in a removing step of the antioxidative mask layer to expose a conductive section 66 protruding from the fourth common lead sublayer 64*d*.

A second insulating interlayer 65*b*, which is composed of $SiO_2$ and has a thickness of approximately 2 μm, is deposited on the first insulating interlayer 65*a* and the conductive section 66 in a second insulating interlayer forming step (Step 8).

The second insulating interlayer 65*b* is patterned by a photolithographic etching process to form openings 65*c* in an opening forming step so that the conductive section 66 is exposed from the second insulating interlayer 65*b* (Step 9).

Signal currents based on the printing information selectively flow in the overlying discrete electrodes 68*b* in this embodiment. The currents reach respective heating elements 69 via the underlying discrete electrodes 68*a* to selectively heat the heating zone S of the heating elements 69. The currents flow towards the external circuit via the underlying common electrode 67*a*, the overlying common electrode 67*b*, the conductive section 66, and the first to fourth common lead sublayers 64*a* to 64*d*. The overlying common electrode 67*b* composed of a highly conductive metal, such as aluminum or copper, assists electrical conduction of the underlying common electrode 67*a* composed of a high-melting point metal, such as chromium.

Although the heating elements 69 are formed on the underlying common electrode 67*a* and the underlying discrete electrodes 68*a* in this embodiment, the heating elements 69 may be formed under the underlying common electrode 67*a* and the underlying discrete electrodes 68*a*. The auxiliary overlying common electrode 67*b* may be omitted.

In the third embodiment, the common lead layer formed on the heat-insulating layer has a four-layer configuration including a cermet first common lead sublayer, a metal second common lead sublayer, a metal third common lead sublayer, and a Ta—cermet fourth common lead sublayer. Thus, the first common lead sublayer functions as an adhesive layer between the heat-insulating layer and the second common lead sublayer, and the third common lead sublayer enhances adhesiveness of the second common lead sublayer to the first common lead sublayer. Thus, the entire common lead layer has high adhesiveness to the heat-insulating layer, and interlayer separation and substrate defects do not occur by thermal impact in the heat treatment step and mechanical impact in the production steps. Accordingly, the quality and yield of the products are improved.

The thermal head in accordance with the present invention has heating elements formed on the insulating interlayer which covers the common lead layer, the common electrode connected to one end of each heating element, and the discrete electrodes connected to the other ends. The common electrode is connected to the common lead layer through the conductive layer exposed on the insulating interlayer, and the second common lead sublayer is provided at the discrete electrode side rather than the heating zone between the discrete electrodes and the common electrode. Thus, the second common lead sublayer does not dissipate the heat generated in the heating zone, and the temperature of the heating zone is effectively increased, resulting in high printing efficiency.

Since the thin metal third common lead sublayer and the opaque Ta-cermet first and fourth common lead sublayers are provided between the heating zone and the heat-insulating layer, the heat generated in the heating zone is not substantially conducted to the heat-insulating layer. Thus, the temperature of the heating zone is effectively increased, resulting in high printing efficiency.

As described above, the first common lead sublayer enhances adhesiveness between the second common lead sublayer and the heat-insulating layer, and the second common lead sublayer provided at a region distant from the heating zone does not dissipate the heat generated in the heating zone. Thus, the second common lead sublayer can have a large thickness. Since the second common lead sublayer has low resistance, it does not cause a decrease in the voltage applied to the heating elements. Thus, high printing quality without irregular printing density is achieved.

Since the second common lead sublayer has a large thickness, low resistance of this layer can be achieved even when the area of the layer is reduced. Thus, the probability of a short-circuit between the second common lead sublayer and the discrete electrodes due to defects in the insulating interlayer is decreased, and the quality and yield of the products are improved.

Since the common lead layer is not exposed at the end of the heat dissipating substrate, short-circuiting of the common lead layer by contact with external units does not occur in use.

The Ta-cermet first common lead sublayer has high adhesiveness. Furthermore, the second and third common lead sublayers are composed of the same material, i.e., chromium. Thus, these lead layers have high adhesion stability, resulting in improved quality and yield of the products.

In the method for making a thermal head in accordance with the present invention, the first insulating interlayer formed by thermal oxidation does not have significant defects. Furthermore, the second insulating interlayer formed on the first insulating interlayer enhances insulation reliability.

What is claimed is:

1. A thermal head comprising:

a heat dissipating substrate;

a heat-insulating layer formed thereon;

a common lead layer formed thereon, the common lead layer having a thin region and a thick region, the thin region for reducing the heat dissipation from the common lead layer, the thick region for reducing the resistance of the common lead layer;

an insulating interlayer formed thereon;

a plurality of heating elements provided on the insulating interlayer, wherein each heating element has a first end and a second end;

a common electrode connected to the first end of each heating element such that the heating elements are connected to each other via the common electrode, the common electrode electrically connected to the common lead layer via a contact hole formed in the insulating interlayer; and a plurality of discrete electrodes connected to the second ends of the heating elements and extended to a terminal section for supplying external electrical power, the plurality of discrete electrodes for independently energizing the heating elements;

wherein the thick region comprises areas of the common lead layer directly below the plurality of discrete electrodes and the thin region comprises areas of the common lead layer directly below the heating elements.

2. A thermal head according to claim 1, wherein the thin region of the common lead layer comprises a high-melting point metal having a melting point of 1,500° C. or more, selected from the group consisting of chromium, molybdenum, titanium, zirconium, tantalum, niobium, tungsten, and hafnium.

3. A thermal head according to claim 1, wherein the thick region of the common lead layer comprises a conductive metal having a resistivity of $1\times10^{-7}$ Ωm or less, selected from the group consisting of aluminum, copper, gold, and nickel.

4. A thermal head comprising:

a heat dissipating substrate; and a heat-insulating layer, a common lead layer, an insulating interlayer having contact holes, a plurality of heating elements, discrete electrodes independently connected to the heating elements, discrete terminals for external connection, a plurality of driver ICs connected to the discrete electrodes and the discrete terminals, a common electrode electrically connecting the common lead layer to the heating elements via the contact holes and connecting the heating elements to each other, and a common terminal for external connection electrically connected to the common lead layer, all elements and layers being formed on the heat dissipating substrate;

wherein the common lead layer is electrically connected to the common terminal via the contact holes that are provided in the vicinity of an edge portion of the heating elements proximate to the plurality of driver ICs.

5. A thermal head according to claim 4, wherein the common terminal for external connection extends in the vicinity of the end of the heat dissipating substrate.

6. A thermal head according to claim 4, wherein the common lead layer is formed only in the vicinity of the heating elements.

7. A thermal head according to claim 4, wherein the common electrode comprises a plurality of layers, and one of the layers comprises a conductive metal having a resistivity of $1\times10^{-7}$ Ωm or less, selected from the group consisting of aluminum, copper, gold, and nickel.

8. A thermal head comprising:

a heat dissipating substrate;

a heat-insulating layer formed thereon;

a common lead layer formed thereon;

an insulating interlayer formed thereon;

a plurality of heating elements provided on the insulating interlayer, a common electrode connected to one end of each heating element, the heating elements being connected to each other via the common electrode; and a plurality of discrete electrodes connected to the other ends of the heating elements, the common electrode being electrically connected to the common lead layer through a contact hole provided in the insulating interlayer;

wherein the common lead layer has a four-layer configuration comprising a first common lead sublayer comprising a cermet formed on the heat-insulating layer, a second common lead sublayer comprising a metal, a third common lead sublayer comprising a metal, and a fourth common lead sublayer comprising a cermet formed thereon, either the second common lead sublayer or the third common lead sublayer being provided only in the vicinity of the heating elements at the side of the discrete electrodes.

9. A thermal head according to claim 8, wherein the first common lead sublayer comprises a Ta cermet, the second common lead sublayer comprises chromium, the third common lead sublayer comprises chromium, and the fourth common lead sublayer comprises a Ta cermet.

10. A thermal head according to claim 8, wherein the first common lead sublayer has a thickness of approximately 0.1 μm, one of the second and third common lead sublayers provided only in the vicinity of the heating elements at the side of the discrete electrodes has a thickness of approximately 1 μm, the other common lead sublayer has a thickness of approximately 0.2 μm, and the fourth common lead sublayer has a thickness of approximately 1 μm.

11. A thermal head according to claim 8, wherein the common electrode comprises a plurality of layers, and one of the layers comprises a conductive metal having a resistivity of $1\times10^{-7}$ Ωm or less, selected from the group consisting of aluminum, copper, gold, and nickel.

12. A thermal head comprising;

a heat dissipating substrate;

a heat-insulating layer formed thereon, the heat-insulating layer having an upper surface;

a common lead layer formed thereon on the upper surface, the common lead layer having an edge section and a peripheral section;

an insulating interlayer formed thereon, the insulating interlayer formed on the upper surface of the heat-insulating layer and the edge section of the common lead layer so as to cover the peripheral section of the common lead layer;

a plurality of heating elements provided on the insulating interlayer;

a common electrode connected to the heating elements, the heating elements being connected to each other via the common electrode; and a plurality of discrete electrodes connected to the heating elements for independently energizing the heating elements, the common electrode, being electrically connected to the common lead layer via a contact hole formed in the insulating interlayer.

* * * * *

UNITED STATES PATENT AND TRADEMARK OFFICE

CERTIFICATE OF CORRECTION

PATENT NO. : 6,201,558 B1
DATED : March 13, 2001
INVENTOR(S) : Takashi Shirakawa et al.

It is certified that error appears in the above-identified patent and that said Letters Patent is hereby corrected as shown below:

Claim 12,
Line 1, immediately after "comprising" delete ";" and substitute -- : -- in its place.
Line 5, delete "thereon".

Signed and Sealed this

Sixteenth Day of April, 2002

*Attest:*

*Attesting Officer*

JAMES E. ROGAN
*Director of the United States Patent and Trademark Office*